US006940015B2

(12) United States Patent
Fang

(10) Patent No.: US 6,940,015 B2
(45) Date of Patent: Sep. 6, 2005

(54) POWER OUTLET STRIP HAVING CHANGEABLE COVER

(76) Inventor: I Hsiung Fang, P.O.Box 10-69, Chong Ho, Taipei (TW) 235

( * ) Notice: Subject to any disclaimer, the term of this patent is extended or adjusted under 35 U.S.C. 154(b) by 55 days.

(21) Appl. No.: 10/733,707

(22) Filed: Dec. 9, 2003

(65) Prior Publication Data

US 2005/0121218 A1 Jun. 9, 2005

(51) Int. Cl.[7] ..... H01H 9/02

(52) U.S. Cl. ..... 174/53; 174/50; 174/59; 439/650; 439/652; 439/188

(58) Field of Search ..... 174/53, 59, 40, 174/48, 58, 57, 66, 67; 220/3.2, 3.3, 3.4, 220/3.5, 3.6, 3.7, 3.8, 3.9, 4.02, 241, 242; 439/650, 505, 214, 535, 139, 188, 652, 701, 439/107, 488, 489, 491

(56) References Cited

U.S. PATENT DOCUMENTS 4,979,907 A * 12/1990 Lee ..... 439/652
5,350,310 A * 9/1994 Chen ..... 439/188
5,425,659 A * 6/1995 Banks ..... 439/650
5,429,518 A * 7/1995 Chen ..... 439/188
6,015,307 A * 1/2000 Chiu et al. ..... 439/188
6,045,399 A * 4/2000 Yu ..... 439/650
6,220,880 B1 * 4/2001 Lee et al. ..... 439/535
6,302,743 B1 * 10/2001 Chiu et al. ..... 439/652
6,332,794 B1 * 12/2001 Tzeng Jeng ..... 439/188
6,454,609 B1 * 9/2002 Huang ..... 439/652

* cited by examiner

*Primary Examiner*—Dean A. Reichard
*Assistant Examiner*—Angel R. Estrada

(57) ABSTRACT

A power outlet strip includes a housing having an upper casing secured to a lower casing and having an opening to receive a cover, the cover includes one or more apertures to receive one or more female receptacles each having two or more holes for receiving prongs. Two or three conductor blades are attached to the female receptacles, and each having one or more spring contacts aligned with the holes of the female receptacle for receiving the prongs. The cover may be changed to the other covers for providing different colors or the like for the outer appearance of the power outlet strip.

15 Claims, 5 Drawing Sheets

POWER OUTLET STRIP HAVING CHANGEABLE COVER

BACKGROUND OF THE INVENTION

1. Field of the Invention

The present invention relates to a power outlet strip, and more particularly to a power outlet strip having a changeable cover that may be changed to different colors or the like.

2. Description of the Prior Art

Various kinds of typical power outlet strips have been developed and comprise a housing, and one or more socket members or female receptacles attached thereto or engaged therein for receiving prongs of plugs, for example. Normally, the housings include a lower casing and an upper casing secured together with fasteners or the like.

However, the upper casings include a solid or one integral piece that may not be changed to different colors or the like.

The present invention has arisen to mitigate and/or obviate the afore-described disadvantages of the conventional power outlet strips.

SUMMARY OF THE INVENTION

The primary objective of the present invention is to provide a power outlet strip including an upper casing having a changeable cover that may be changed to the other covers for providing different colors or the like for the outer appearance of the power outlet strip.

In accordance with one aspect of the invention, there is provided a power outlet strip comprising a housing including a lower casing and an upper casing secured together, the upper casing including an opening formed therein and defined by a peripheral fence, a cover engageable into the opening of the upper casing, and engageable with the peripheral fence, to anchor the cover to the upper casing, the cover including at least one aperture formed therein, at least one female receptacle engageable into the aperture of the cover, and including at least two holes formed therein for receiving prongs, and two conductor blades attached to the female receptacle, and each including at least one spring contact provided thereon and aligned with the holes of the female receptacle respectively for receiving the prongs.

The cover includes an outer peripheral wall having at least one peripheral flange laterally extended from the outer peripheral wall, to engage with the peripheral fence of the upper casing, and to anchor the cover to the upper casing. The cover includes at least one notch formed therein, the upper casing includes at least one catch extended therefrom and engaged into the notch of the cover, to secure the cover and the upper casing together.

The cover includes at least one peripheral fence extended therefrom to define the aperture thereof, and to receive the female receptacle therein. The female receptacle includes at least one notch formed therein, the cover includes at least one catch extended therefrom and engaged into the notch of the female receptacle, to secure the cover and the female receptacle together.

The female receptacle includes at least two conduits extended therefrom to define the holes of the female receptacle, and to receive the spring contact of the conductors respectively. Each of the conduits of the female receptacle includes a slot formed therein, to receive and to anchor the conductors to the female receptacle.

Each of the conduits of the female receptacle includes at least one rib extended therefrom, to engage with the spring contact of the conductors respectively, and to anchor the spring contact of the conductors to the conduits of the female receptacle.

A third conductor blade may further be provided and disposed in the housing for grounding purposes. The female receptacle includes a third conduit extended therefrom to define at least one third hole therein, and the third conductor includes at least one spring contact extended therefrom and engaged into the third hole of the third conduit.

The third conductor includes at least one aperture formed therein, the cover includes at least one peg extended therefrom, and engaged into the aperture of the third conductor, to anchor the third conductor to the cover. The lower casing includes at least one protrusion extended therefrom and engaged with the third conductor blade, to anchor the third conductor blade to the cover.

The lower casing includes at least one extension extended therefrom and engaged between the two conductor blades, to separate the two conductor blades from each other.

The cover includes an orifice formed therein, and a master switch is further provided and received in the orifice of the cover for controlling the power outlet strip. Each of the two conductor blades includes at least one projection extended therefrom for engaging with the prongs.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
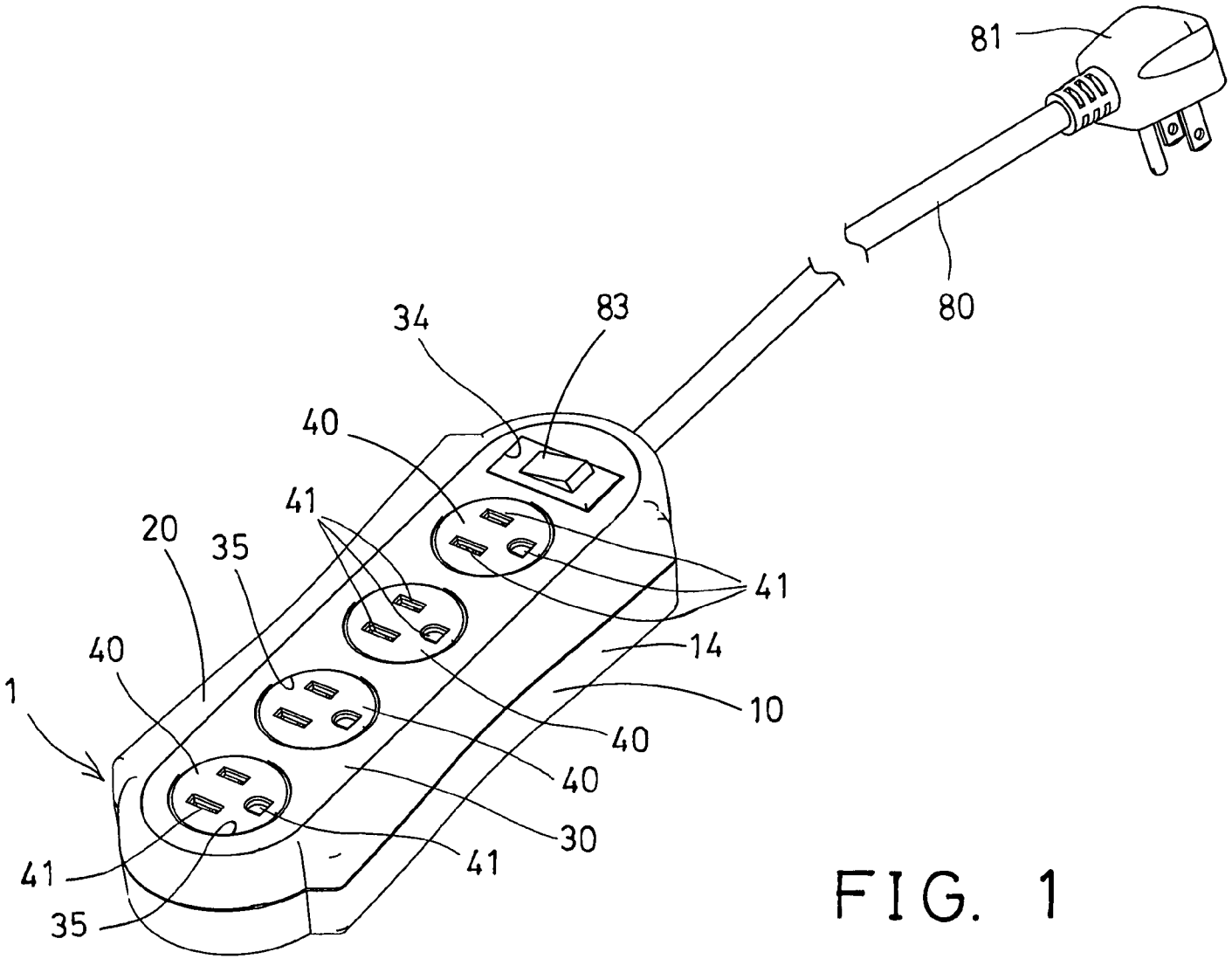
FIG. 1 is a perspective view of a power outlet strip in accordance with the present invention.
Figure 2:
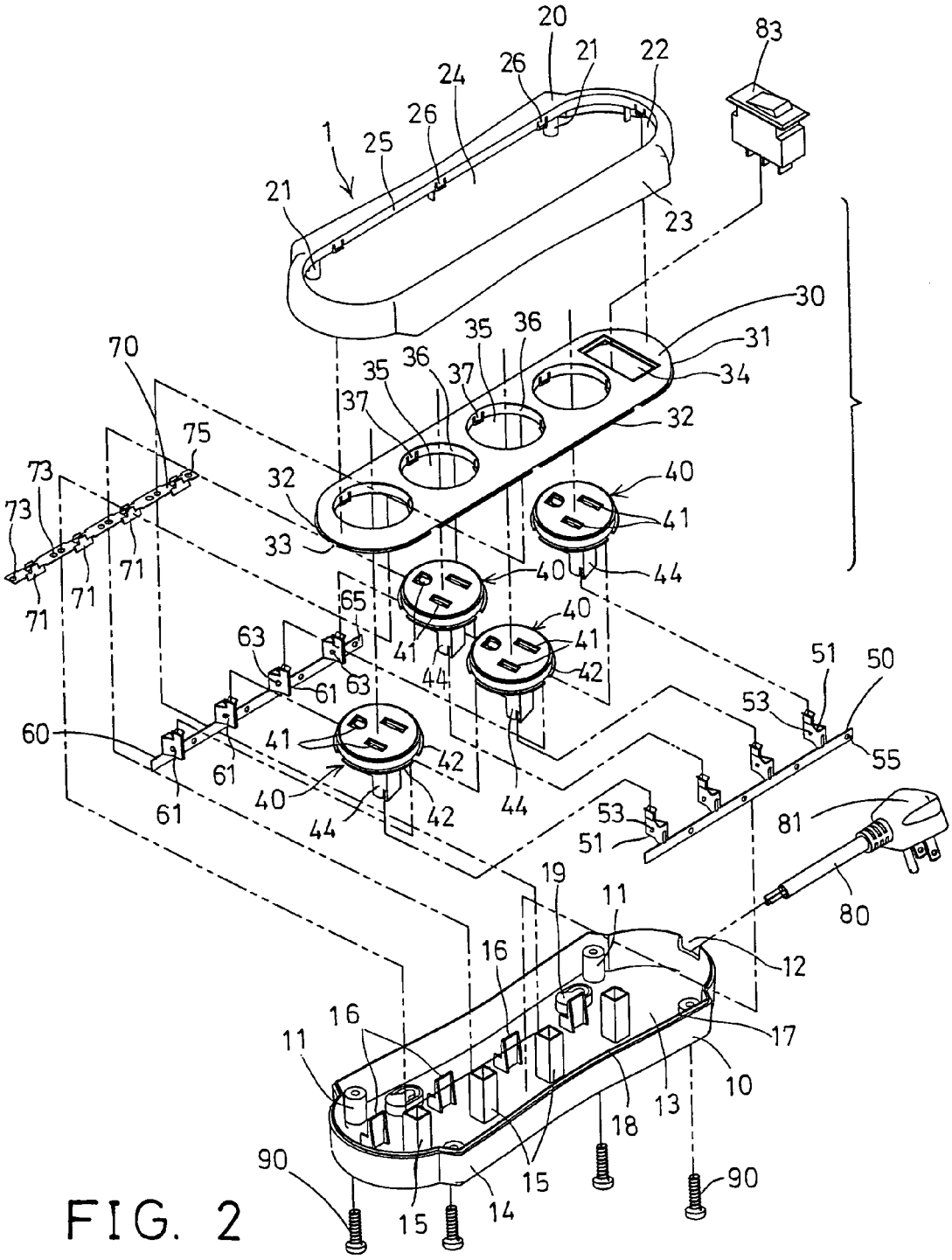
FIG. 2 is an exploded view of the power outlet strip.
Figure 3:
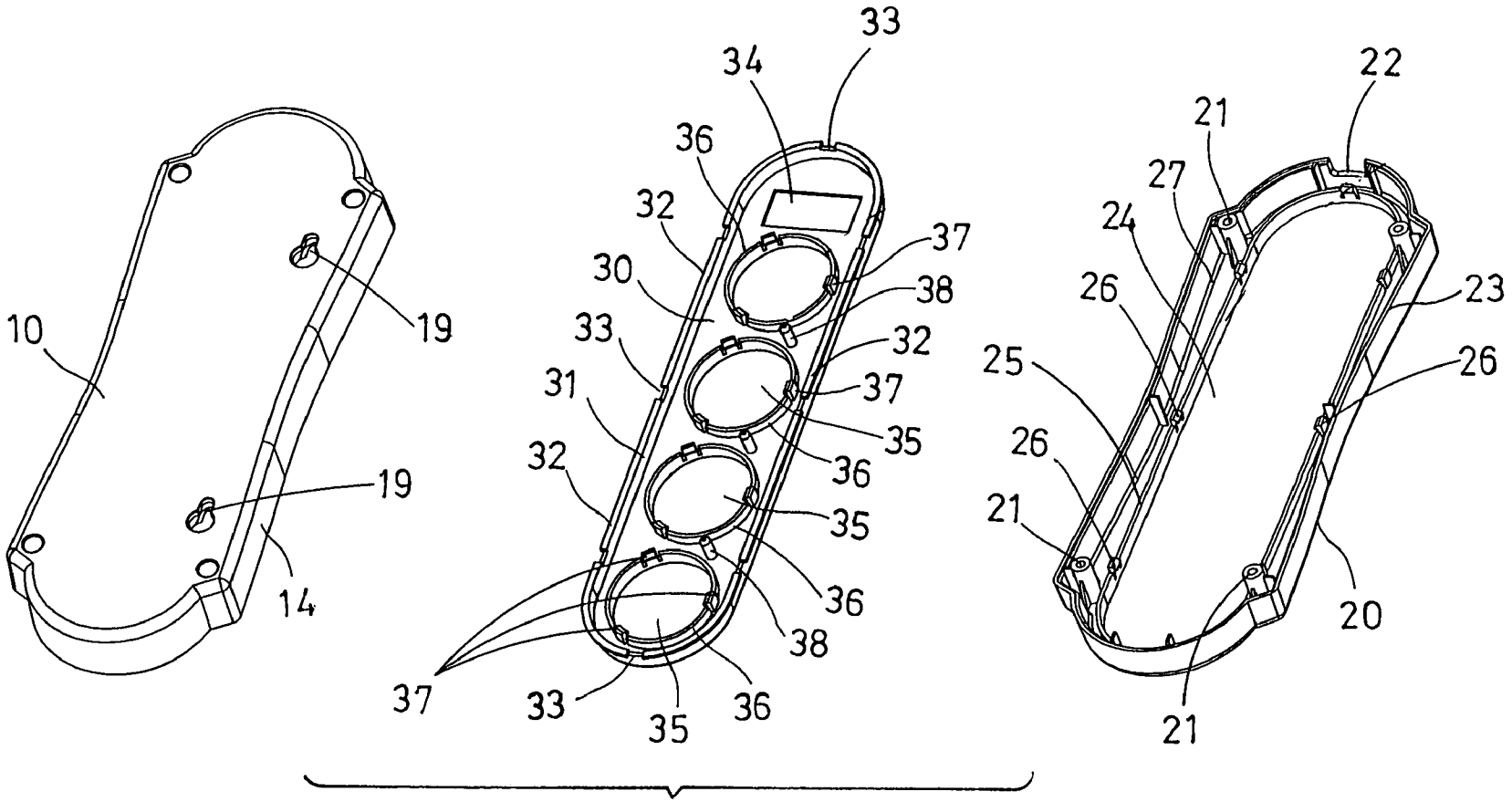
FIG. 3 is a partial exploded view of the power outlet strip, as seen from the direction opposite to that shown in FIG. 2.

Referring to the drawings, and initially to FIGS. 1–3, a power outlet strip in accordance with the present invention comprises a housing 1 including such as a lower casing 10 and an upper casing 20 secured together by fasteners 90 or the like. For example, each of the lower casing 10 and the upper casing 20 includes one or more studs 11, 21 provided therein for being secured together by the fasteners 90 or the like.

Each of the lower casing 10 and the upper casing 20 includes a notch 12, 22 formed therein for receiving an electric cable 80 which is coupled to a plug 81 for coupling to various electric power sources. The lower casing 10 includes a chamber 13 formed therein and defined by a peripheral wall 14, and includes one or more protrusions 15 and one or more extensions 16 extended or provided in the chamber 13 thereof.

The lower casing 10 further includes an outer peripheral skirt 17 extended upwardly therefrom for forming or defining an outer peripheral shoulder 18 therein, and includes one or more key holes 19 formed therein (FIG. 3) for hanging to such as supporting surfaces or walls, or the like. The upper casing 20 includes an outer peripheral wall 23 formed therein, and engaged into the outer peripheral shoulder 18 of the lower casing 10, to secure or anchor the lower casing 10 and the upper casing 20 together.

The upper casing 20 includes an opening 24 formed therein and defined by an inner peripheral fence 25, and one or more hooks or catches 26 extended from or provided on the inner peripheral fence 25, and one or more ribs 27 formed or provided between the inner peripheral fence 25 and the outer peripheral wall 23, for reinforcing the upper casing 20.

A cover 30 is engaged into and received in the opening 24 of the upper casing 20, and includes an outer peripheral wall 31 extended therefrom and having one or more peripheral flanges 32 laterally extended from the outer peripheral wall 31; to engage with the inner peripheral fence 25 of the upper casing 20, and to secure or anchor the cover 30 to the upper casing 20.

The cover 30 further includes one or more notches 33 formed therein for receiving the catches 26 of the upper casing 20, and for securing the cover 30 and the upper casing 20 together. The cover 30 further includes an orifice 34 formed therein for receiving a master switch 83 which may be provided or used for controlling or operating the power outlet strip.

Figure 4:
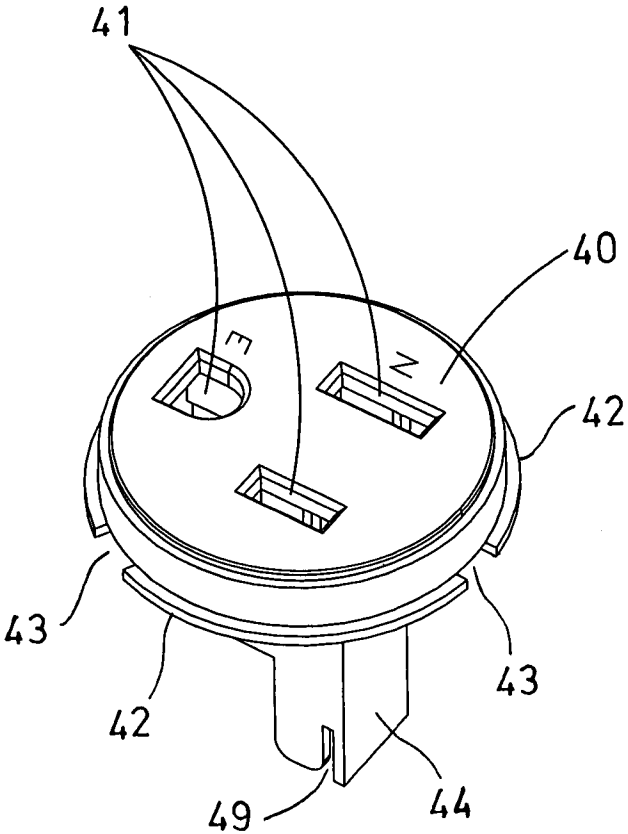
FIG. 4 is an upper perspective view of a female receptacle of the power outlet strip.

The cover 30 further includes one or more apertures 35 formed therein and each defined by a peripheral fence 36, for receiving female receptacles 40 therein respectively, and includes one or more hooks or catches 37 extended from or provided on each of the peripheral fence 36, for engaging with and for hooking or securing the female receptacles 40 to the cover 30. Each of the female receptacles 40 includes two or three holes 41 formed therein (FIGS. 1, 2, 4) for receiving prongs of plugs (not shown).

Each of the female receptacles 40 further includes one or more peripheral flanges 42 laterally extended outwardly therefrom, to engage with the peripheral fence 36 of the cover 30, and to secure or anchor the female receptacles 40 to the cover 30. Each of the female receptacles 40 further includes one or more notches 43 formed therein for receiving the catches 37 of the cover 30, and for securing the cover 30 and the female receptacles 40 together.

Figure 5:
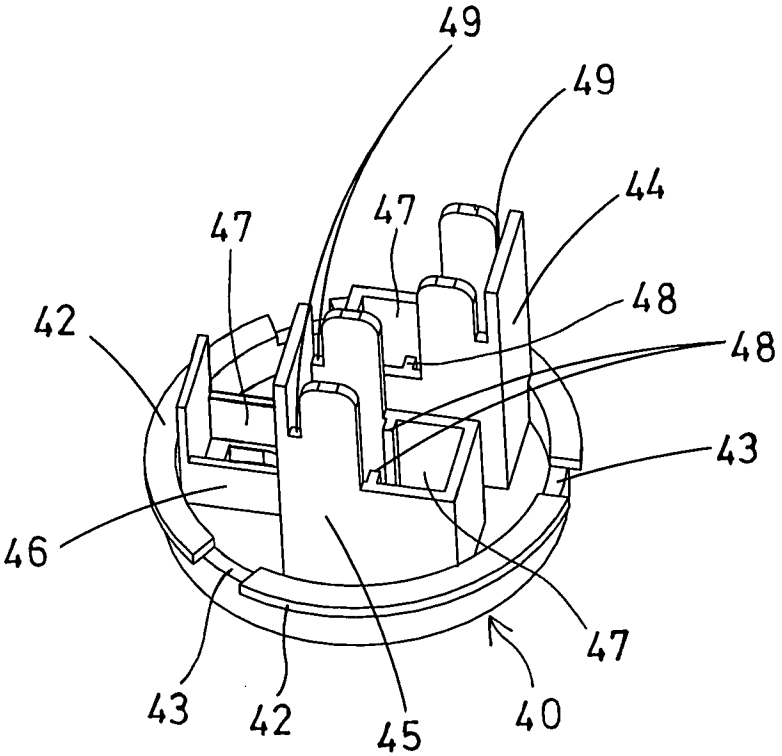
FIG. 5 is a lower perspective view of the female receptacle of the power outlet strip.
Figure 6:
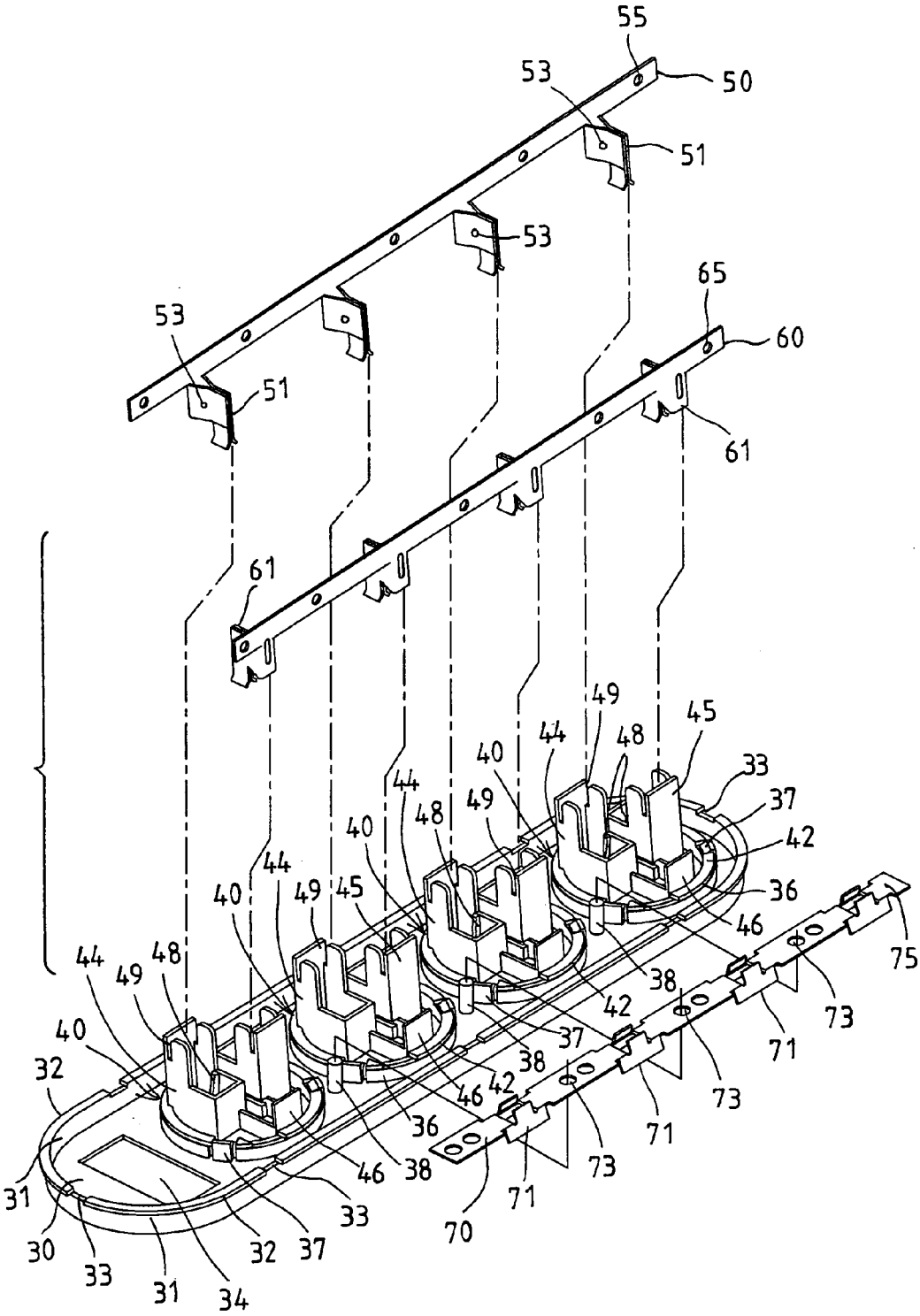
FIG. 6 is another partial exploded view of the power outlet strip, as seen from the direction opposite to that shown in FIG. 2.

As shown in FIGS. 5 and 6, each of the female receptacles 40 further includes two or three conduits 44, 45, 46 provided therein or extended therefrom, and each having a space 47 formed therein. Each of the conduits 44, 45 further includes one or more ribs 48 provided therein or extended into the space 47 thereof, and further includes one or more slots 49 formed therein.

Two conductor blades 50, 60 may be engaged into the slots 49 of the conduits 44, 45 respectively (FIG. 6), to anchor or secure the conductor blades 50, 60 to the conduits 44, 45 respectively, with such as force-fitted engagements. Another conductor blade 70 may further be provided and attached or secured to the other conduits 46, for such as grounding purposes.

Each of the conductor blades 50, 60, 70 includes one or more spring contacts 51, 61, 71 provided thereon or extended therefrom, and engaged into the spaces 47 of the conduits 44, 45, 46 respectively, and aligned with the holes 41 of the female receptacles 40 respectively, for receiving the prongs of the plugs. Each of the spring contacts 51, 61 preferably includes one or more projections 53, 63 extended therefrom, for engaging with and for retaining the prongs to the spring contacts 51, 61.

The ribs 48 of the conduits 44, 45 may further be engaged with the spring contacts 51, 61 of the conductor blades 50, 60 respectively, to further solidly secure or retain the spring contacts 51, 61 of the conductor blades 50, 60 to the conduits 44, 45 respectively, and to prevent the spring contacts 51, 61 of the conductor blades 50, 60 from being disengaged from the conduits 44, 45.

The cover 30 may further include one or more pegs 38 extended therefrom, and the conductor blade 70 may further include one or more apertures 73 formed therein for receiving the pegs 38 of the cover 30, and for anchoring or securing the conductor blade 70 to the cover 30. Each of the conductor blades 50, 60, 70 further includes one or more orifices 55, 65, 75 formed therein for coupling to the electric cable 80.

In operation, the cover 30 and/or the female receptacles 40 may be changed to the other ones, or the other covers 30 and/or the other female receptacles 40 may be changeably secured to the housing 1, for providing different colors or shapes or contours or the like for the outer appearance of the power outlet strip.

The protrusions 15 of the lower casing 10 or of the housing 1 may be engaged with the conductor blade 70, or may be forced against the conductor blade 70, to solidly secure or anchor the conductor blade 70 to the cover 30. The extensions 16 of the lower casing 10 or of the housing 1 may be engaged between the conductor blades 50, 60, to prevent the conductor blades 50, 60 from being contacted together.

Accordingly, the power outlet strip in accordance with the present invention includes an upper casing having a changeable cover that may be changed to the other covers for providing different colors or the like for the outer appearance of the power outlet strip.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A power outlet strip comprising:

a housing including a lower casing and an upper casing secured together, said upper casing including an opening formed therein and defined by a peripheral fence, a cover engageable into said opening of said upper casing, and engageable with said peripheral fence, to anchor said cover to said upper casing, said cover including at least one aperture formed therein, at least one female receptacle engageable into said at least one aperture of said cover, and including at least two holes formed therein for receiving prongs, and two conductor blades attached to said at least one female receptacle, and each including at least one spring contact provided thereon and aligned with said at least two holes of said at least one female receptacle respectively for receiving the prongs.

2. The power outlet strip as claimed in claim 1, wherein said cover includes an outer peripheral wall having at least one peripheral flange laterally extended from said outer peripheral wall, to engage with said peripheral fence of said upper casing, and to anchor said cover to said upper casing.

3. The power outlet strip as claimed in claim 1, wherein said cover includes at least one notch formed therein, said upper casing includes at least one catch extended therefrom and engaged into said at least one notch of said cover, to secure said cover and said upper casing together.

4. The power outlet strip as claimed in claim 1, wherein said cover includes at least one peripheral fence extended therefrom to define said at least one aperture thereof, and to receive said at least one female receptacle therein.

5. The power outlet strip as claimed in claim 1, wherein said at least one female receptacle includes at least one notch formed therein, said cover includes at least one catch extended therefrom and engaged into said at least one notch of said at least one female receptacle, to secure said cover and said at least one female receptacle together.

6. The power outlet strip as claimed in claim 1, wherein said at least one female receptacle includes at least two conduits extended therefrom to define said at least two holes of said at least one female receptacle, and to receive said at least one spring contact of said conductors respectively.

7. The power outlet strip as claimed in claim 6, wherein each of said at least two conduits of said at least one female receptacle includes a slot formed therein, to receive and to anchor said conductors to said at least one female receptacle.

8. The power outlet strip as claimed in claim 6, wherein each of said at least two conduits of said at least one female receptacle includes at least one rib extended therefrom, to engage with said at least one spring contact of said conductors respectively, and to anchor said at least one spring contact of said conductors to said at least two conduits of said at least one female receptacle respectively.

9. The power outlet strip as claimed in claim 1 further comprising a third conductor blade disposed in said housing for grounding purposes.

10. The power outlet strip as claimed in claim 9, wherein said at least one female receptacle includes a third conduit extended therefrom to define at least one third hole therein, and said third conductor includes at least one spring contact extended therefrom and engaged into said at least one third hole of said third conduit.

11. The power outlet strip as claimed in claim 9, wherein said third conductor includes at least one aperture formed therein, said cover includes at least one peg extended therefrom, and engaged into said at least one aperture of said third conductor, to anchor said third conductor to said cover.

12. The power outlet strip as claimed in claim 9, wherein said lower casing includes at least one protrusion extended therefrom and engaged with said third conductor blade, to anchor said third conductor blade to said cover.

13. The power outlet strip as claimed in claim 1, wherein said lower casing includes at least one extension extended therefrom and engaged between said two conductor blades, to separate said two conductor blades from each other.

14. The power outlet strip as claimed in claim 1, wherein said cover includes an orifice formed therein, and a master switch is further provided and received in said orifice of said cover for controlling said power outlet strip.

15. The power outlet strip as claimed in claim 1, wherein each of said two conductor blades includes at least one projection extended therefrom for engaging with the prongs.

* * * * *